US005423921A

United States Patent [19]

Saal et al.

[11] Patent Number: 5,423,921

[45] Date of Patent: Jun. 13, 1995

[54] METHOD AND APPARATUS FOR CLEANING TEXTILES

[76] Inventors: Hans-Udo Saal, Bergstrasse 99, D-5340 Bad Honnef; Ralf M. Saal, Karolinger Str. 11, D-5463 Unkel, both of Germany

[21] Appl. No.: 84,273

[22] PCT Filed: Oct. 6, 1992

[86] PCT No.: PCT/EP92/02304

§ 371 Date: Jul. 7, 1993

§ 102(e) Date: Jul. 7, 1993

[87] PCT Pub. No.: WO93/10301

PCT Pub. Date: May 27, 1993

[30] Foreign Application Priority Data

Nov. 18, 1991 [DE] Germany ..... 41 37 932.2

[51] Int. Cl.[6] ..... B08B 3/04; B08B 7/00; D06F 43/00

[52] U.S. Cl. ..... 134/26; 134/10; 134/25.4; 134/42; 68/18 C; 68/209

[58] Field of Search ..... 134/26, 42, 25.4, 10; 68/18 C, 209

[56] References Cited

U.S. PATENT DOCUMENTS 4,572,723 2/1986 Ward ..... 55/25

FOREIGN PATENT DOCUMENTS 0422603 4/1991 European Pat. Off. .
700093 11/1940 Germany .
3544168 4/1987 Germany .
3627875 2/1988 Germany .

*Primary Examiner*—Melvyn J. Andrews
*Assistant Examiner*—Zeinab El-Arini
*Attorney, Agent, or Firm*—George W. Dishong

[57] ABSTRACT

The invention relates to an apparatus for cleaning textiles by means of FCHC-free solvents on a benzine basis, comprising a cleaning machine, distillation section, recovery section and drier, and is characterized by a means for injecting protective gas into the drier.

12 Claims, 2 Drawing Sheets

METHOD AND APPARATUS FOR CLEANING TEXTILES

BACKGROUND OF THE INVENTION

1. Field of the Invention

The invention relates to a method for cleaning textiles in FCHC-free manner by means of solvents on a benzine basis.

The invention also relates to the use of such a method.

2. Description of the Prior Art

Finally, the invention also relates to an apparatus for cleaning textiles by means of FCHC-free solvents on a benzine basis comprising a cleaning machine, distillation section, recovery section and drier.

Generally, in such a cleaning plant the drying takes place (after transferring the material from the cleaning machine) by means of hot air; the textile material in particular predried by spinning in a drum in the cleaning machine (for example down to 11% residual moisture content) is further dried and the cleaning agent is recovered from the solvent-charged air by distillation and condensation.

However, particular safety precautions are necessary here because the solvent on a benzine basis involves a considerable danger of explosion, at the least from the flashpoint of the solvent (71° C.) used upwards. Also, the operations under vacuum necessary because of this are very complicated. FCHCs are however allowed for only a short period and the use of PER involves increasingly high demands on the apparatus quality, and consequently both the FCHC-operated and the PER-operated machines must be replaced or at least considerably modified. In addition, with all existing machines and the cleaning agents used therein a practically 100% distillation was necessary due to the considerable contamination of the cleaning agent.

Also known is a method for dry cleaning with a hydrocarbon having a low flashpoint (41° C.) and high vapour pressure (EP 90 119 398.7). A so-called dry-to-dry cleaning machine is described, i.e. a machine in which both washing and drying is carried out. With this type of solvent, for safety, technical, humane-ecological and ecological reasons reloading in the moist state is not compatible with European standards, in particular German standards. In this case hot air is forced in between the washing bath and the dry conduit and the evaporated solvent condensed for recovery. Before this solvent recovery step a partial vacuum is generated and an inert gas introduced. The inert gas is however introduced into the washing bath until the oxygen density of a mixture containing a solvent assumes a value beneath a predetermined limit value. After the introduction of the inert gas into the washing bath (reduction of the oxygen density) washing, centrifuging and finally drying are carried out.

SUMMARY OF THE INVENTION

To be more exact, the rendering inert therein takes place as follows:

a) Firstly by generating a partial vacuum, the aim being to achieve a residual oxygen content of 5 vol. %. This means however that the operations must be carried out with a gas-tight machine.

b) In addition, inert gas, presumably from a nitrogen tank, is injected in to set the residual oxygen content to 5%. The method is technically complicated and involves the aforementioned problems such as the technically involved vacuum method with gas-tight machine.

Compared therewith, the invention is based on the problem of providing a method and an apparatus which operate not only PER-free and FCHC-free but in addition reduce the expenditure considerably and with which the drying operation can be carried out practically free of any danger even when individual apparatus parts should fail in their function.

This is achieved in surprisingly simple manner with a method of the type set forth at the beginning in that the drying is carried out under a protective gas.

Preferably, the drying is carried out under nitrogen.

It is particularly expedient to carry out the drying with nitrogen obtained from the air, oxygen being filtered out of the air in a manner known per se.

Pressure bottles, separate connections, and the replacement of such pressure bottles or tanks can be dispensed with if nitrogen obtained in situ is used for the drying.

Preferably, N2 is injected into the drier itself.

Preferably, the operation is carried out with an aroma-free solvent known per se and having a low evaporation value, in particular N-Undecane.

Expediently, the procedure is such that with a temperature of 55° C. in the closed system drying is carried out in particular to 15° C. beneath the theoretical flashpoint.

It is favourable to carry out the drying with an oxygen content of 6% in the drying gas, i.e. with a value far below the explosion limit.

It is particularly advantageous to operate with nitrogen flushing without vacuum, and almost ambient pressure conditions can be employed during the drying.

With the step according to the invention, FCHC (fluorochlorohydrocarbon)-operated apparatuses and PER-operated apparatuses may be considered obsolete. After appropriate prespotting the articles are cleaned in the cleaning machine, the latter being a sprung machine which is provided with an upper gear-type motor drive. A high centrifuging speed is possible and consequently 89% of the solvent is extracted in spinning and only 11% later in the drier after the articles have been transferred.

The transferring permits simultaneous operation of the drier and cleaning machine with the advantage that this doubles the capacity of the system compared with conventional dry-to-dry techniques. The transfer is made possible by the low evaporation value when N-Undecane is used as cleaning agent. If two driers are employed in the system the capacity of the apparatus may even be increased to three times the charging value.

Furthermore, a distillation unit is provided, the capacity of which can be limited to 70 liters per second due to the use of the N-Undecane, which can be handled without any problems. Hitherto, a distillation of 100% was necessary but with the step of the invention 20% distillation suffices. The distillation operates under vacuum.

Cartridge filters may be employed.

By connecting a refrigeration apparatus to the drier the cleaning agent can be recovered practically completely and the solvent loss here is 1%. By employing this apparatus the theoretical danger of fire is eliminated. It is physically impossible for a flame to exist in the nitrogen air mixture created (oxygen content beneath 10% or beneath 6%).

The solvent used corresponds to the same risk class as light fuel oil. Contact water occurs only in small amounts.

Due to the inert gas (protective gas) production in the system any change of bottles or supply tanks is eliminated; no follow-up costs arise for the protective gas.

Separate safety circuits are present in the system, firstly to keep the temperature 15° C. beneath the flashpoint of the solvent (71° C.) and secondly for monitoring the O2 concentration, trouble alarms being given with the O2 concentration rises above 6%. However, even at 10% there is no fear of any danger of explosion.

The apparatus for cleaning textiles by means of FCHC-free solvents on a benzine basis comprising a cleaning machine, distillation section, recovery section and drier is therefore distinguished by supplying of protective gas into the drier.

A metering conduit for N2 may be led from the reservoir of a separate N2 recovery apparatus into the drier and the N2 apparatus can derive the nitrogen from the air. A separate microprocessor control may be provided for controlling and monitoring the temperature profile, and another microprocessor control for the oxygen concentration during the drying operation. Connections may be provided to the drier which supply the gaseous medium saturated with solvent and vapour to a cooling apparatus for condensation, in particular at 3° C.

The plant or apparatus is also distinguished by operation of the drier under approximately ambient pressure conditions.

Finally, the invention is also distinguished by the use of nitrogen from an apparatus recovering nitrogen from air and known per se in the drier of a cleaning machine for textiles operating free of FCHC.

The mode of operation of the drier is as follows: In the drying operation the gaseous medium in the closed drier is conducted via a fan past a heat register (both within the drier) and heated to 55° C. The hot air withdraws the solvent residual moisture from the textiles in a rotating drum. The saturated hot air is cooled in a cooling apparatus to 3° C., condensing out the solvent. The separated solvent is returned to the cleaning machine. The solvent recovery is 99%. If required, the solvent from two reservoirs of the cleaning machine is reprocessed in the distillation unit.

In the drying, the solvent mentioned and consisting of pure hydrocarbon having a theoretical flashpoint of 71° C. is used, the drying being carried out 15° C. beneath the flashpoint.

BRIEF DESCRIPTION OF THE DRAWINGS

An example of embodiment of the invention will now be explained in detail with the aid of the attached drawings, wherein.

DESCRIPTION OF THE PREFERRED EMBODIMENTS

Figure 1:
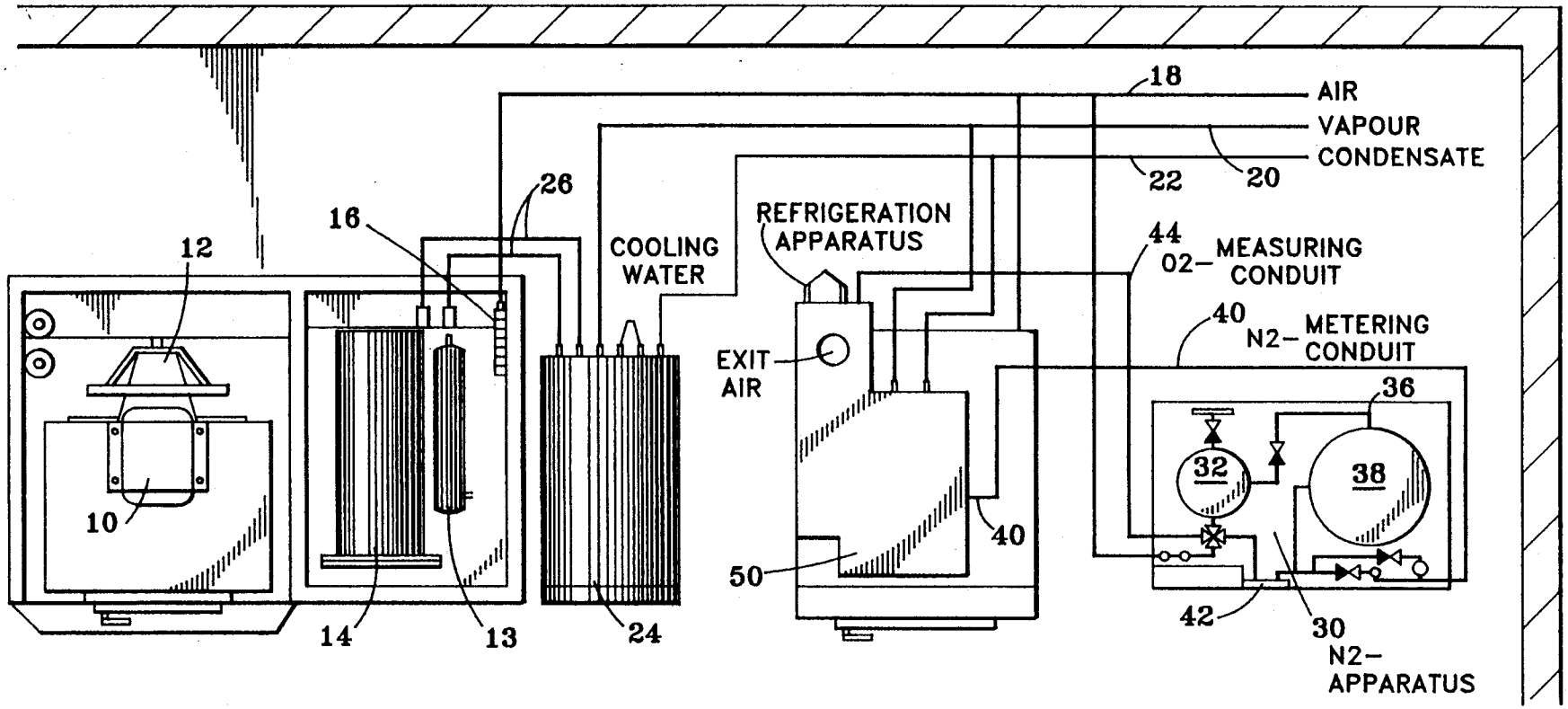
FIG. 1 shows a schematic illustration of an apparatus which is surrounded by an outer wall to show how small the apparatus can be constructed.

On the left in FIG. 1 the cleaning machine 10 can be seen; supply drums not illustrated are provided beneath the cleaning machine. The cleaning machine is drive via a motor gear-type unit 12.

At the start and during the entire drying operation, the oxygen concentration within the drier is reduced to far beneath the theoretical explosion limit so that even when the flame point is exceeded no inflammable atmosphere can form in the drier. In contrast to the prior art, the nitrogen flushing in the drier takes place without any vacuum, being carried out on the contrary under approximately normal atmospheric pressure conditions.

In the same housing with the drive machine a filter 14 for the solvent is provided. The illustration is schematic. In fact, two filters are installed above each other. The first of the two identically constructed filters is the prefilter and the other the afterfilter.

A solvent cooler 13 is arranged laterally adjacent the filter 14 in the drawings.

Finally, in the same housing magnetic valves 16 are also arranged for the control functions of the cleaning machine.

Arranged alongside in the drawing is a distillation apparatus which is indirectly heated with steam via 20. 70 liters are withdrawn per hour from the distillation apparatus 24, cleaned, the bottom removed and the condensate returned to the cleaning machine via 26.

Shown in the drawings completely on the right is an N2 apparatus which is known per se and is not the subject of the invention; the effect (N2 production) thereof is merely utilized. The N2 apparatus 30 receives air from the conduit 18. A filter and a pump are provided at 32. These operate by a novel pressure alternating principle, the so-called "pressure swing absorption (PSA)": A pulsating pump effect is utilized in an active carbon filter. Air is inspired and on ejection the filter 32 repels oxygen. Via a conduit 36 the nitrogen passes to a reservoir 38 from which via the conduit 40 nitrogen can be injected as desired into the drier, in particular discontinuously, when the nitrogen content has dropped below a predetermined limit or the oxygen content runs the risk of increasing above a predetermined limit (6%). An O2 measuring conduit 44 leads from the control unit 42 to the drier 50.

The central part of the present invention is the drier 50 into which nitrogen 40 is injected as protective gas. The clean material is introduced into the drier for instance by a snorkel transfer method. Heating is effected by passage past a heating register (fan action) to 55° C. in the closed system, i.e. 15° C. beneath the explosion point, thereby providing double safety because critical O2 values are never reached. The residual moisture of the material being cleaned is practically expelled by the heating to 55° C. The 55° C. hot medium is supplied to the refrigeration apparatus (not shown) where a cooling to 3° C. is effected and the residual moisture condensed. After possible cleaning the latter is returned to the cleaning machine. The drier is indirectly heated with vapour or steam 20. A rotating drum may be employed.

The conditions in the drier are controlled via a microprocessor control. An O2 measuring device inspires fresh air. Prior to the drying operation a system is passed to the N2 apparatus. A flushing with N2 is carried out until the oxygen content drops below 6%. Another signal indicates readiness for operation.

Figure 2:
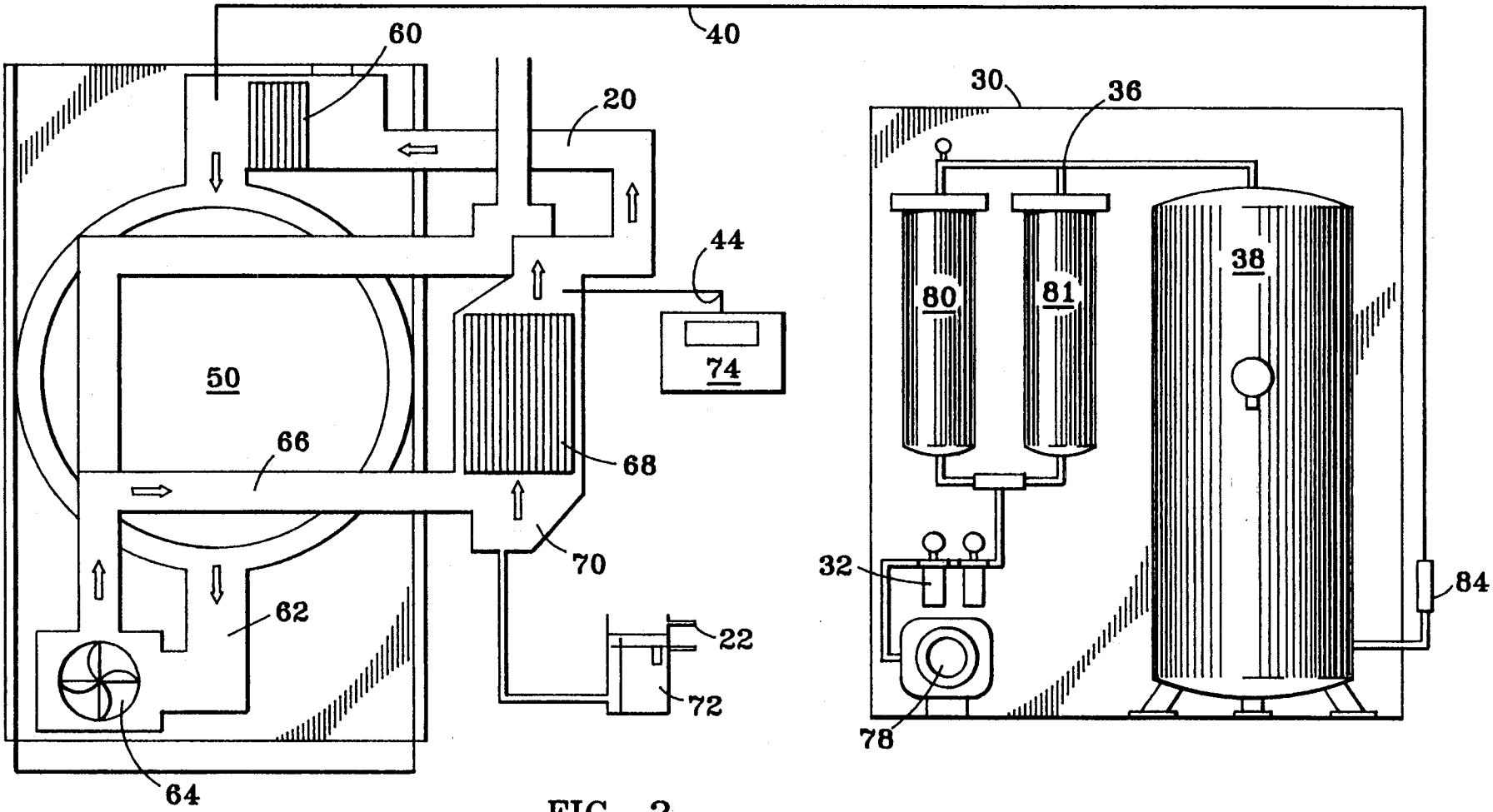
FIG. 2 shows such an apparatus from the constructional side.

In FIG. 2, which shows a detail of the drier arrangement and N2 preparation, the same reference numerals as in FIG. 1 have been used for identical elements.

The drying drum 50 has been emphasized as the central element. Nitrogen generated from the air is injected into the drum of the drier 50 via the conduit 40 past a heating register 60. The still moist material is transferred from the cleaning machine 10, not illustrated here.

The heating to the aforementioned temperature takes place in the drum 50; the moisture and solvent are expelled (62). Recycling is effected via a fan 64. The mixture flows on at 66 and enters an evaporator 68, the liquid N2 being supplied together with condensed water via 70 to a water separator 72. The condensate is removed via 22. The steam returns in the cycle at 20 to the heat register. Following the evaporator 68, a measuring conduit 44 branches off to an O2 analyzer 74. An O2 value of 6% is set in the drier.

The N2 apparatus 30 takes up air, compresses the latter at 78, filters it at 32 and supplies it to adsorbers 80 and 81. The nitrogen generated is supplied at 36 via an N2 reservoir 38, from which it is supplied via a controlled flow meter 84 to the aforementioned N2 metering conduit. 62 is a heating conduit.

The cleaning machine according to the invention thus does not clean either in vacuum or in gas-tight manner or under protective gas.

The invention has nothing in common with the prior art in which many PER machines are simply modified for benzine or petrol (danger of explosion!).

According to the invention, the operation may be carried out with a solvent with high flashpoint of for example 71° C. at a low vapour pressure. This alone provides protection against explosion only in the drying by means of hot air, i.e. rendering inert, this protection not being provided in the washing itself.

Due to the step according to the invention of separately washing and drying (separate apparatus components, i.e. cleaning machine and drier), each aggregate can be designed to suit its optimum respective purpose. The transfer method, which is the foundation of the invention, thus permits simultaneous washing and drying of different batches and therefore gives twice the capacity (economical advantage for the user). The rendering inert takes place only in the drier and not in the washing drum by the special aggregate which is employed specifically for this purpose and which recovers nitrogen from the ambient air and consequently dispenses with technically complicated vacuum method and gas-tight machines.

We claim:

1. Method of dry cleaning of textiles comprising the steps of:

washing the textiles under atmospheric pressure in a separate cleaning machine using a solvent free of FCHC, free of aromates based on hydrocarbons having a flash point of at least 55° C. under low pressure;

drying the textiles in a separate drier wherein the drying is conducted in a protection gas atmosphere having an oxygen content of at most 10%;

condensing the solvent vapors, originating in the separate drier, to 3° C. creating thereby solvent condensate; and recycling the solvent condensate, for use in the cleaning machine.

2. Method according to claim 1, wherein said solvent free of FCHC is n-Unecane.

3. Method according to claim 1, wherein said protection gas is nitrogen.

4. Method according to claim 3, further comprising the step of generating, from air taken from surrounding atmosphere, said nitrogen protection gas.

5. Method according to claim 1, further comprising the step of controlling temperature in said drier during said drying to to at least 15° C. below flash point of said solvent.

6. Apparatus for cleaning textile materials, comprising:

a separate cleaning machine into which is placed the textile material to be cleaned producing thereby cleaned textile material;

a drier into which the cleaned textile materials are placed and into which protection gas is injected resulting in cleaned and dried textile materials;

a heating register for heating the protection gas; and a micro-processing control unit for controlling and regulating temperature and oxygen percentage within said drier.

7. Apparatus according to claim 6, further comprising independent safety circuits for control and monitoring of a temperature profile up to a limit temperature, in particular 55° C., approximately 15° C. beneath the flashpoint of the cleaning solvent, and for control and monitoring of the oxygen concentration in the drier when the drier is in operation, in particular to 6%.

8. Apparatus according to claim 6, wherein a fan within the drier conducts the gaseous drying medium to a heat register.

9. Apparatus according to claim 6, further comprising connections at the dier for supplying the gaseous medium saturated with solvent and vapors to a cooling apparatus for condensation of the solvent and vapors, in particular at about 3° C.

10. Apparatus according to claim 6, wherein the drier operates approximately under ambient conditions.

11. Apparatus according to claim 6, further comprising a distillation apparatus.

12. Apparatus according to claim 6, further comprising means for snorkel transfer of the cleaned textile materials from the separate cleaning machine into the separate drier.

* * * * *